US007608767B1

(12) United States Patent
Barth

(10) Patent No.: US 7,608,767 B1
(45) Date of Patent: Oct. 27, 2009

(54) DUAL USE TROMBONE

(75) Inventor: Richard G. Barth, Granger, IN (US)

(73) Assignee: Gemeinhardt Company LLC, Elkhart, IN (US)

( * ) Notice: Subject to any disclaimer, the term of this patent is extended or adjusted under 35 U.S.C. 154(b) by 0 days.

(21) Appl. No.: 12/156,044

(22) Filed: May 29, 2008

(51) Int. Cl.
*G10D 9/02* (2006.01)

(52) U.S. Cl. ..... 84/383 R

(58) Field of Classification Search ..... 84/327, 84/329, 395, 387 R
See application file for complete search history.

(56) References Cited

U.S. PATENT DOCUMENTS 4,831,911 A * 5/1989 Wanner ..... 84/395

* cited by examiner

*Primary Examiner*—Kimberly R Lockett
(74) *Attorney, Agent, or Firm*—Clifford W. Browning; Krieg DeVault LLP

(57) ABSTRACT

In a large bore symphony tenor trombone having a detachable and interchangeable bass mouthpipe, the improvement comprising, interchanging the bass mouthpipe with a tenor mouthpipe that will accommodate a tenor shank mouthpiece at its proximate end and that tapers from its proximate end to its distal end to the straight bore dimension of the large bore symphony tenor trombone, whereby an acoustically shaped air column is created between a tenor shank mouthpiece and the straight bore dimension of the large bore symphony tenor trombone, and whereby the tenor mouthpipe changes the acoustical and playing characteristics of the large bore symphony tenor trombone to those of a small bore tenor trombone.

4 Claims, 4 Drawing Sheets

DUAL USE TROMBONE

BACKGROUND OF THE INVENTION

The present invention relates generally to brass musical instruments, and more particularly to the mouthpipes of trombones.

Trombones come in a variety of cylindrical bore dimensions, from as small as 0.481" to as large as 0.562". They are generally grouped into two categories, based on their bore dimensions. Those trombones having a bore dimension of 0.525" or smaller, and which accommodate a tenor shank mouthpiece 30, are usually referred to as "small bore tenor trombones." Those trombones having a bore dimension of 0.547" or larger, and which accommodate a bass shank mouthpiece 130, are usually referred to as "large bore symphony tenor trombones," or in the case of a bore dimension of 0.562", simply as "tenor trombones." There are variants to these conventions that include trombones with a bore dimension of 0.525" on the top slide, which is the slide that receives the mouthpiece, and increases the bore dimension to 0.547" on the bottom slide. These trombones still accommodate only the small bore tenor trombone mouthpiece shank.

The large bore symphony tenor trombones produce a sound that is particularly well suited for use in a symphony orchestra or in a concert band. The small bore tenor trombones produce a sound that is particularly well suited for a recording studio or in a night club.

Heretofore, a hard working trombone musician who played in a symphony orchestra or concert band, and also in a recording studio or night club would had to carry two trombones, one large bore symphony tenor trombone and one small bore tenor trombone, as there has never been a single trombone that would produce the quality sound of both a large bore symphony tenor trombone and a small bore tenor trombone.

Detachable and interchangeable mouthpipes for trombones, also known as venturi tubes or leadpipes, into which the trombone's mouthpiece is inserted, have existed for many years. Detachable and interchangeable mouthpipes now exist and they are available from various trombone manufacturers. Small bore tenor trombones have utilized detachable interchangeable tenor mouthpipes with varying rates of taper, but without changing the trombones' principal small bore tenor trombone sound. Large bore symphony tenor trombones have also utilized interchangeable detachable bass mouthpipes with varying rates of taper, but again without changing the trombones' principal large bore symphony tenor trombone sound.

There exists a small bore tenor trombone with a bore dimension of 0.525" that has an alternative tenor mouthpipe that is flared-out at its proximate end to accommodate a bass shank mouthpiece, but this alternative arrangement does not transform the small bore tenor trombone into an acoustically sound large bore symphony tenor trombone. There also exist very short adaptors that fit into the proximate end of the bass mouthpipe of a large bore symphony tenor trombone to accommodate a small shank mouthpiece, but these short adaptors do not transform the large bore symphony tenor trombone into an acoustically sound small bore tenor trombone.

SUMMARY OF THE PRESENT INVENTION

Recognizing the need for a hard working musician's trombone, the present invention transforms a large bore symphony tenor trombone into a dual use trombone that has the acoustic versatility to go from a symphony orchestra or concert band to a recording studio or night club.

This novel acoustic versatility has been accomplished by means of the novel alternative mouthpipe of the present invention, which is detachable and interchangeable, and which allows a trombone to accommodate two very different mouthpipes. One mouthpipe is the typical bass mouthpipe with a base shank mouthpiece 130 that is associated with a large bore symphony tenor trombone. The alternative mouthpipe 10 of the present invention is a tenor mouthpipe that accommodates a tenor shank mouthpiece 30 and that gradually tapers out from the mouth piece smoothly and acoustically to the bore dimension of the large bore symphony tenor trombone 12. The alternative mouthpipe 10 of the present invention is longer and is a more gradually tapered tenor mouthpipe than are the tenor mouthpipes 112 of the prior art. When the alternative mouthpipe 10 of the present invention replaces the bass mouthpipe 110 of a large bore symphony tenor trombone 12, the result is that without changing instruments, or hand slides, the trombone musician is provided with the support, acoustic resistance and sound of a small bore tenor trombone from the large bore symphony tenor trombone 12.

Thus, the present invention provides a novel construction for trombone mouthpipes that provides an acoustically shaped air column between a tenor shank mouthpiece 30 and the straight bore dimension of a large bore symphony tenor trombone 12. This improved acoustical shape comprises a zone of increasing taper that is precisely located along the length of the alternative mouthpipe 10 and that merges smoothly with the main cylindrical bore dimension of the large bore symphony tenor trombone 12. The zone of increased taper blends the taper and acoustic characteristics of the small bore tenor trombone mouthpipe 112 with the bore dimension of a larger bore symphony trombone 12, thereby achieving the playing characteristics of a small bore tenor trombone from a large bore symphony tenor trombone 12.

The use of the alternative mouthpipe 10 of the present invention in a large bore symphony tenor trombone 12 specifically results in a large bore symphony tenor trombone that can be made to respond and acoustically perform and thus sound like a small bore tenor trombone.

DESCRIPTION OF THE DRAWINGS

These and other features of the present invention will become more apparent upon reference to the attached drawings wherein.

DETAILED DESCRIPTION OF THE PREFERRED EMBODIMENT

Figure 1:
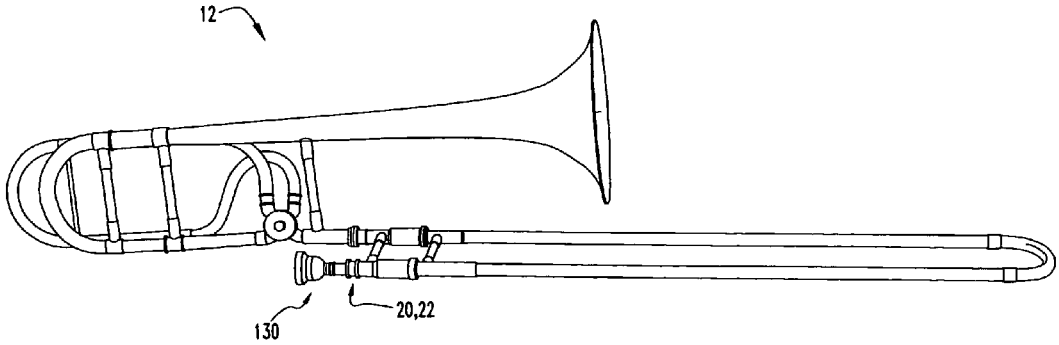
FIG. 1 is an elevation view of a representative large bore symphony tenor trombone 12 having a detachable, interchangeable mouthpipe.

The preferred embodiment of the present invention is a detachable, interchangeable alternative mouthpipe 10 that changes the playing and acoustic characteristics of a large bore symphony tenor trombone 12 into the playing and acoustic characteristics of a small bore tenor trombone. This is accomplished by providing a large bore symphony tenor trombone 12 with the alternative mouthpipe 10 of the present invention.

The uniqueness of the present invention is that the alternative mouthpipe 10 of the present invention provides the means for placing a small bore tenor trombone mouthpiece shank 14 into a small bore tenor trombone mouthpipe mouthpiece receiver 16, the bore of which thereafter progressively enlarges at a rate such that the taper at the distal end 18 of the alternative mouthpipe 10 has enlarged the bore dimension to that required to fit mechanically and acoustically into the bore dimension of a large bore symphony tenor trombone 12.

Figure 2:
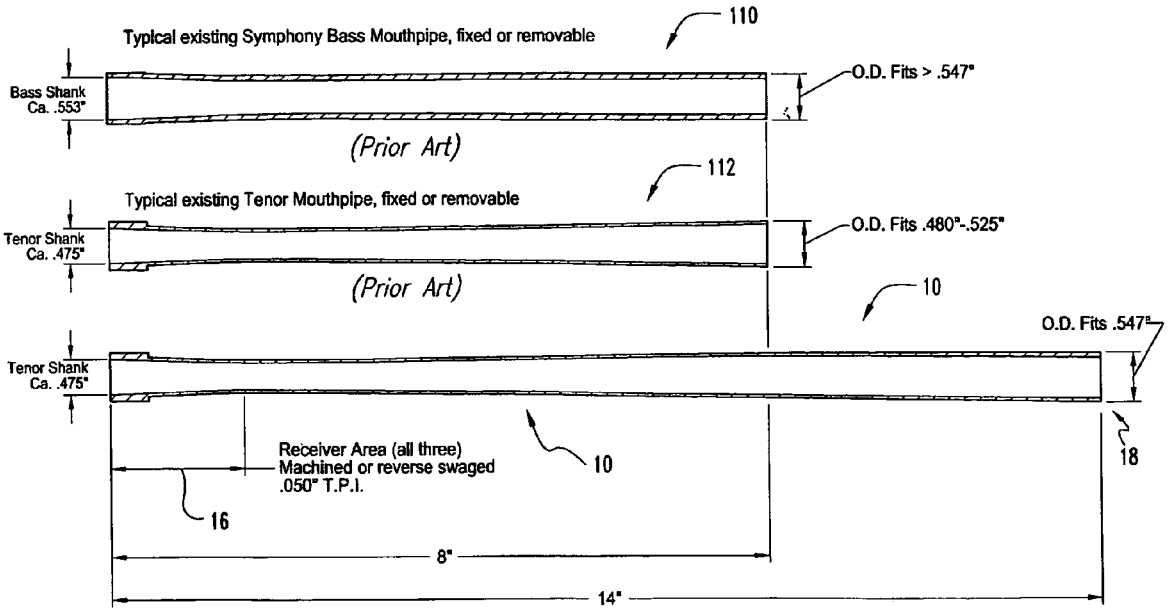
FIG. 2 is a cross-sectional view of a prior art symphony tenor mouthpipe 110, fixed or removable; a prior art tenor mouthpipe 112, fixed or removable; and the preferred embodiment of the alternative mouthpipe 10 of the present invention.

Whereas mouthpipes of the prior art 110, 112 (FIG. 2) are less than 9" in length, the alternative mouthpipe 10 of the present invention is 10" or more in length. In testing completed to date an effective length has been 14", although it can made to be acoustically effective at lengths of 10" to 28", provided the alternative mouthpipe 10 is giving the trombone musician the resistance, focus, acoustics, and sound of a small bore tenor trombone from within a large bore symphony tenor trombone 12.

The alternative mouthpipe 10 of the present invention may be constructed in these varying lengths yet still achieve the desired acoustic results, provided that one starts with a small bore tenor trombone's mouthpiece 30 shank 14 dimension and tapers the alternative mouthpipe progressively larger in a manner that achieves at its distal end 18 the bore dimension that is associated with the large bore symphony tenor trombone 12.

The 14" length of the alternative mouthpipe 10 of the preferred embodiment to date was arrived at by continuing the taper of a typical small bore tenor trombone mouthpipe 112 until it reached the bore size of the large bore symphony tenor trombone 12. A typical small bore tenor trombone has an internal cylindrical bore dimension of 0.508". Small bore tenor trombones range in bore size from 0.480" to 0.525", with many sizes and options in between.

The rate of taper of the small bore tenor trombone mouthpipes 112 currently in use varies by brand and model. Because of the variety of sizes and tapers of existing small bore tenor trombone mouthpipes 112, a variety of alternative mouthpipes 10 of the present invention can be made to achieve results similar to the 14" preferred embodiment to date. For example, by starting with the bore dimensions of a 0.481" in a small bore tenor trombone mouthpipe and continuing the taper until the bore achieves a 0.547" large bore symphony tenor fit, the alternative mouthpipe 10 would be considerable longer than 14", the exact length being determined by the rate of taper of the model from which the initial taper is drawn. Using a typical rate of taper of 0.010" of taper per inch, starting from a 0.525" small bore mouthpipe would result in a shorter alternative mouthpipe 10 of the present invention.

Figure 3:
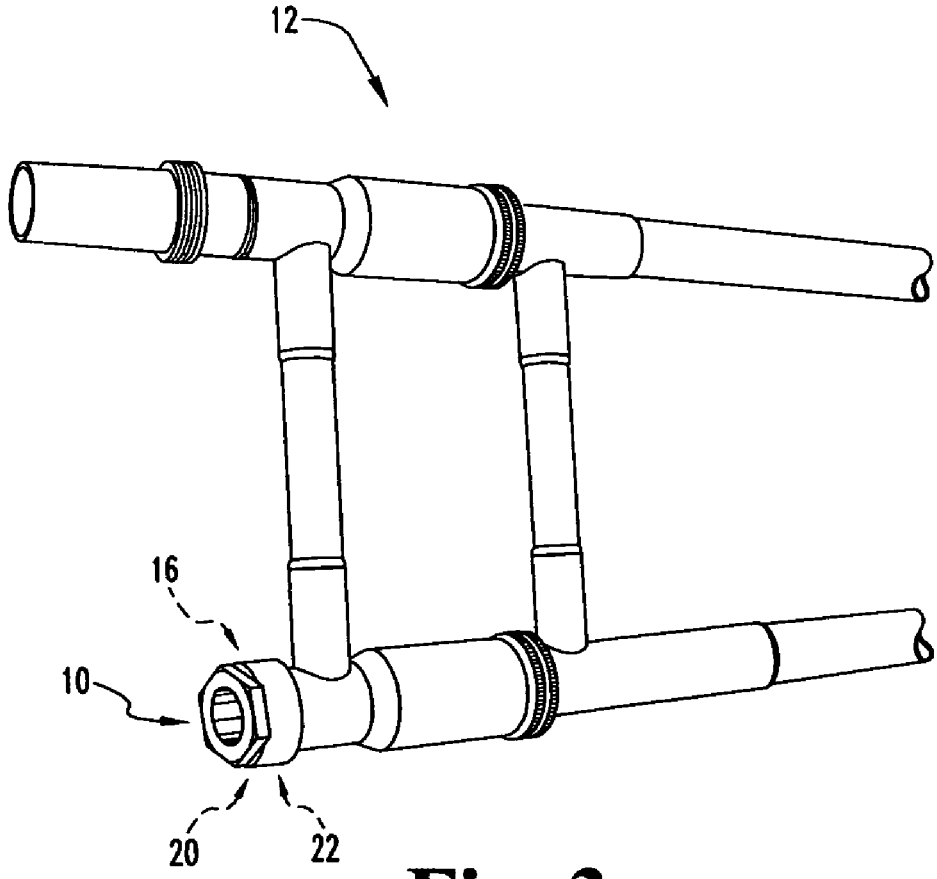
FIG. 3 a perspective sectional view of the top and bottom slides of the trombone 12 of FIG. 1, the top slide being the slide that receives a mouthpiece.
Figure 4:
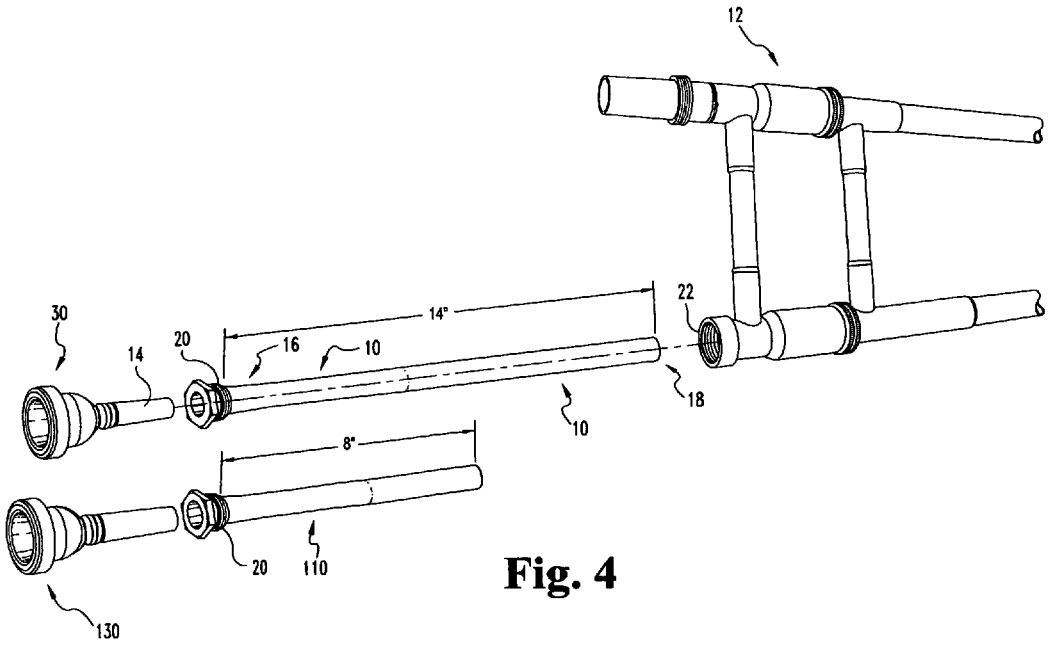
FIG. 4 is an exploded, perspective sectional view of FIG. 3, illustrating the alternative mouthpipe 10 of the present invention with an associated tenor shank mouthpiece 30 and the prior art symphony tenor mouthpipe 110, shown removable, of FIG. 2, associated with a bass shank mouthpiece 130.

The 14" alternative mouthpipe 10 of the preferred embodiment to date was constructed in the typical way, well known in the art, by constructing a steel mandrel with the taper of the inside selected for the desired mouthpipe. A brass tube is drawn through a steel washer that swages the brass down on to the mandrel. The alternative mouthpipe 10 of the preferred embodiment as illustrated is intended to be interchanged with the prior art large bore symphony tenor trombone 12 mouthpipes 110 that are removable by threaded couplings 20, 22 as illustrated in FIGS. 3 and 4, or press fittings or any other suitable method of connection used in the prior art symphony tenor mouthpipes.

The alternative mouth pipe 10 of the present invention may be a fixed yet detachable mouthpipe, a drawn or bored mouthpipe, a mouthpipe that is reverse swaged (usually a Morse taper) or is joined to a receiver, threaded or not, or other similar variants. The preferred alternative mouthpipe 10 to date has proven in testing done to date to also be effective with either a machined mouthpiece shank receiver or with a reverse swage for the mouthpiece shank receiver.

Testing to date has been done by skilled professional trombonists, who favorably compared the performance of large bore symphony tenor trombone fitted with the alternative mouthpipe 10 of the present invention to known small bore tenor trombones.

I claim:

1. In a large bore symphony tenor trombone having a detachable and interchangeable bass mouthpipe, the improvement comprising, interchanging the bass mouthpipe with a tenor mouthpipe that will accommodate a tenor shank mouthpiece at its proximate end and that tapers from its proximate end to its distal end to the straight bore dimension of the large bore symphony tenor trombone, whereby an acoustically shaped air column is created between a tenor shank mouthpiece and the straight bore dimension of the large bore symphony tenor trombone, and whereby the tenor mouthpipe changes the acoustical and playing characteristics of the large bore symphony tenor trombone to those of a small bore tenor trombone.

2. The improvement of claim 1, wherein the length of the tapered tenor mouthpipe from its distal to its proximate end is from 10 to 28 inches.

3. The improvement of claim 2, wherein the rate of taper of the tenor shank mouthpipe from its proximate to distal end is about 0.010 inches of taper per inch.

4. A dual use large bore symphony tenor trombone, comprising, a large bore symphony tenor trombone having a detachable and interchangeable bass mouthpipe that receives a bass shank mouth piece at its proximate end, and a detachable and interchangeable tenor mouthpipe that receives a tenor shank mouth piece at its proximate end, and that tapers from its proximate end to its distal end to the straight bore dimension of the large bore symphony tenor trombone, whereby an acoustically shaped air column is created between a tenor shank mouthpiece and the straight bore dimension of the large bore symphony tenor trombone, and whereby the tenor mouthpipe changes the acoustical and playing characteristics of the large bore symphony tenor trombone to those of a small bore tenor trombone.

* * * * *